US005848450A

United States Patent [19]

Oexman et al.

[11] Patent Number: 5,848,450

[45] Date of Patent: Dec. 15, 1998

[54] AIR BED CONTROL

[75] Inventors: Robert D. Oexman, Carthage, Mo.; David B. Scott, Parkland, Fla.

[73] Assignee: L&P Property Management Company, South Gate, Calif.

[21] Appl. No.: 611,381

[22] Filed: Mar. 5, 1996

[51] Int. Cl.[6] ..... A47C 27/08

[52] U.S. Cl. ..... 5/713; 5/706; 5/710

[58] Field of Search ..... 5/715, 706, 690, 5/710, 713, 722, 726

[56] References Cited

U.S. PATENT DOCUMENTS

| | | | |
|---|---|---|---|
| 4,394,784 | 7/1983 | Swenson et al. . | |
| 4,662,012 | 5/1987 | Torbet . | |
| 4,722,105 | 2/1988 | Douglas . | |
| 4,962,552 | 10/1990 | Hasty . | |
| 5,005,240 | 4/1991 | Vrzalik | 5/713 |
| 5,062,169 | 11/1991 | Kennedy | 5/713 |
| 5,129,115 | 7/1992 | Higgins et al. . | |
| 5,182,826 | 2/1993 | Thomas et al. | 5/713 |
| 5,279,010 | 1/1994 | Ferrand et al. | 5/713 |
| 5,509,154 | 4/1996 | Shafer et al. | 5/713 |

*Primary Examiner*—Steven Meyers
*Assistant Examiner*—Tuye T. Phuong Pham
*Attorney, Agent, or Firm*—Wood, Herron & Evans, L.L.P.

[57] ABSTRACT

An airbed having multi-zone air mattress is provided having a control that can identify the configuration of any of a plurality of hand control units connected thereto and can interpret control functions differently based on the identified unit configuration. A plurality of normally closed valves seal pressures in each of the zones when power to an air pump is off while mattress zone pressures are constantly monitored and the measurements sent by the control through a communications port for monitoring of the motion or care of a user of the bed and for analysis and diagnosis. When pump power is on, the pressure in the zones is regulated at predetermined pressure settings ideal for the user. Deviations from ideal pressure cause a programmed controller to calculate inflation or deflation times for the respective zones that would be required to inflate or exhaust the zones to the desired pressures. Ideal pressures for individual users are automatically calculated by inflating the zones to initial pressures and sealing them. Then, a user reclines on the bed and pressures are measured. From the measured pressures, ideal pressure settings are calculated that will support the user in an ideal manner, such as maintaining the user in an ideal sleeping posture with a minimum amount of pressure in the zones. The sitting up of the user, the sitting of the user on the edge of the bed, the adjustment of bed inclination angles and other non-reclining conditions are detected by analysis of the pressures in the zones or information from other sources to set pressures particularly suited to such conditions.

14 Claims, 4 Drawing Sheets

AIR BED CONTROL

The present invention relates to the control of the inflation or pressures in air beds or air mattresses, and particularly to the automatic control and monitoring of the relative pressures in multiple section or zone pneumatic mattresses or beds for the health or comfort of a patient or other user.

BACKGROUND OF THE INVENTION

Air beds or air mattresses for such beds are disclosed in a number of U.S. patents, for example, in U.S. Pat. No. 4,662,012 to Torbet and in U.S. Pat. No. 5,062,169 of Kennedy et al., both hereby expressly incorporated herein by reference. Such air mattresses are typically formed of a pair of air impermeable sheets or membranes, usually of a reinforced thermoplastic material, vacuum formed to define a plurality of cells that are usually arranged into a plurality of rows. The rows are grouped into a plurality of zones, for example, four in number, with the cells and rows within each of the zones being interconnected so that they maintain a common pressure within each of the zones. The zones are typically longitudinally spaced and extend transverse to the mattress, across the entire width of the mattress. The plural zone mattress provides a structure that will support different portions of a users body differently, such as a head or upper body zone to support the upper body of a user at one pressure, a waist zone to support the user's waist at a second pressure, a hip zone to support the user's hip region at a third pressure and a foot zone to support the users legs at a fourth pressure. The differing pressures of the zones are used for a number of purposes, including, as in the Torbet patent, supporting the user during rest or sleep with the body in some preferred state of alignment. The support provided by such mattress increases the comfort of the user, improves the quality of sleep experienced by the user, and facilitates the treatment of the user in a health care facility.

Air mattresses have been provided with an inflation system that usually includes a pump, sometimes an accumulator tank, a system of valves and a control, usually electric, that controls the inflation and deflation of the zones of the mattress and maintains the pressures within them according to some criteria. The ideal pressure settings of the zones of such mattresses, however, vary from patient to patient. The controls of the prior art have been ineffective in developing zone inflation criteria that maintain the proper settings that are ideal for a wide range of users who would recline upon the beds on which such air mattresses are used. Further, the air mattress controls of the prior art have failed to adequately accommodate transient conditions in the use of such beds, such as where the user sits up or sits upon the edge of the mattress or bed, where the user turns, or where the inclination of adjustable portions of the bed are changed. In addition, such controls of the prior art have failed to provide users with a control interface that provides maximum control over the state of the mattress for users having the skills to operate controls that vary over a wide range, or for attendants that have need for a different level of control than is convenient for the actual user of the bed.

Accordingly, in the art of controlling the levels of inflation of an air bed, there remains a need for a control that overcomes the deficiencies of the prior art.

SUMMARY OF THE INVENTION

A primary objective of the present invention is to provide an airbed system with a control that is effective to develop zone inflation pressures that maintain the proper settings. It is a particular objective of the present invention to provide such a control for such a system that automatically arrives at zone pressures that are ideal for a wide range of users who would recline upon the beds on which such air mattresses are used.

It is still a further objective of the present invention to provide air mattress controls that adequately accommodate transient conditions in the use of such beds, such as where the user sits up or sits upon the edge of the mattress or bed, where the user turns, or where the inclination of adjustable portions of the bed are changed.

It is an additional objective of the present invention to provide controls for an airbed system that provide users with a control interface that gives each user maximum control over the state of the mattress where various degrees of complexity may be desired or ideal for different users, or for users having various degrees of skill to operate controls, or to accommodate both users and attendants who desire different features to control.

According to the principles of the present invention, there is provided an airbed system having a control by which the pressures of a plurality of zones of an air mattress are controlled and maintained at levels beneficial to or desired by a user reclining on the bed. According to the preferred embodiment of the invention, a computer control is provided by which pressures are held in multiple zones of a bed, and varied up or down in accordance with deviations between predetermined pressure settings and the actual pressure of the zones. The zone pressures are adjusted by calculating ideal time intervals at which valves controlling air flow into or out of the respective zones of the bed should be opened to provide minimum cycling of the valves. A separate timer is provided for each zone to take into account the size of the zone and the differing inflate and deflate rates of the different zones. Controls are provided for a user to manually adjust the pressure settings that will be automatically maintained to the comfort or health of the user. The controls also provide that such pressures can be adjusted to control the overall firmness by adjusting all zones equally, proportionately or according to some other relationship or algorithm. Zones can be selected with the controls and individually adjusted separately from the others. Such adjusted values are stored as the user's settings, but can be reset to initial values based on factory defaults or ideal user calculations.

According to certain principles of the invention, the control is provided with a programmed routine that can be selected by a user to calculate ideal zone pressure settings for the user. The routine supplements a method by which the pressures in the zones are set to standardized pressures and the zones are sealed, when the user then reclines upon the bed, the pressures are automatically measured in the zones, as affected by the weight of the user thereon, and an adjustment number is calculated using a principal component analysis. From the calculated adjustment number, ideal pressures for the user at which each of the zones are to be set to provide the lowest pressure while maintaining optimal support for the user. Optimal support may be that which provides a particular alignment for the users spine or achieves some other criteria, such as a criterium that reduces pressure on certain joints, such as the shoulder or hip, that may be prone to produce pain when improperly supported. The hip and waist zone support pressures are calculated using a least square regression analysis, while the head and foot zone support pressures are calculated by using a spline fit method. These calculated support pressure are then automatically maintained by the computer control until manually adjusted or reset by the user.

The flexibility of the control is enhanced, according to certain other principles of the invention, by utilizing one internal control that is programmed to respond to a number of different remote control wands of varying degrees of complexity. The controls range from a simple on/off control, to controls including overall firmness control, individual zone pressure selection and control, hyperinflation and deflation control, reset and calibration or learn mode feature selection, and can include menu scrolling of feature selection and full computer user interfaces for advanced control, diagnostic and multiple unit control purposes. A communication port allows for diagnostic uses and for the monitoring of user activity as well as patient care.

In accordance with other features of the present invention, certain embodiments are provided with the ability to detect motions such as the sitting of the user on the edge of the bed, to which the control responds by disabling zone pressure adjustment. In addition, detection of the angles of inclination of the head or foot of adjustable beds is detected, to which the control responds, for example, by sealing off the hip zone and alternatively also the waist zone, or otherwise adjusts or controls the hip or waist zone pressures to properly support the increased weight of the user on these zones of the mattress.

As a result of the present invention, ideal, desired and beneficial pressure distribution across the zones of a multiple zone airbed are achieved and maintained, for the normal reclining use as well as for other motions of the bed or user. Flexible user control is provided and a system of a single design and program can accommodate a variety of levels of use.

These and other objects and advantages of this invention will be more readily apparent from the following description of the drawings in which:

DETAILED DESCRIPTION OF THE DRAWINGS

Figure 1:
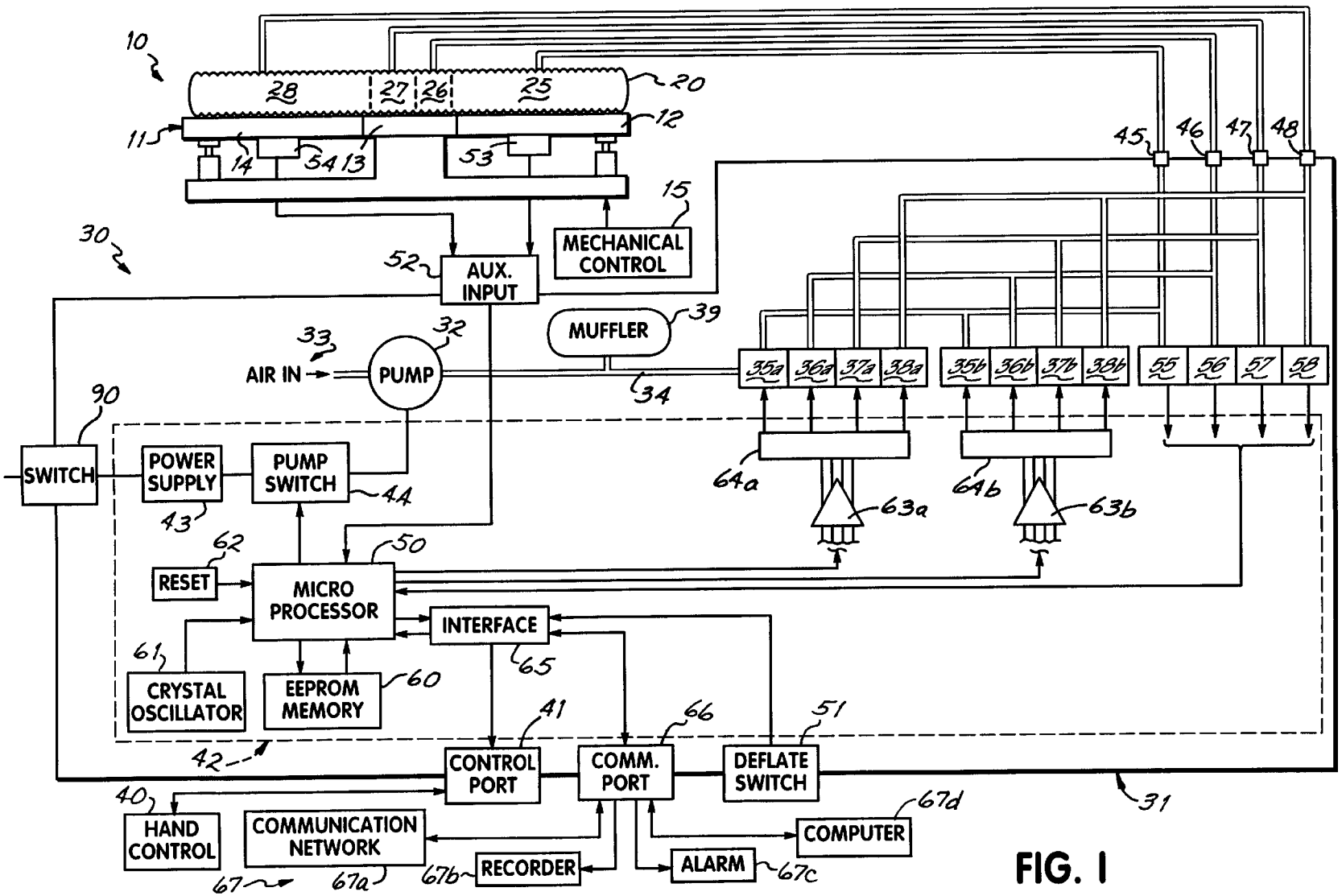
FIG. 1 is a schematic diagram of an airbed system embodying principles of the present invention.

An air bed system 10 in accordance with a preferred embodiment of the present invention is diagrammatically illustrated in FIG. 1. The system 10 includes a bed or mattress support 11, which may be a platform, box spring unit, hospital bed frame or other such structure. In the illustrated embodiment, the mattress support 11 is a hospital bed having a pivotal head section 12, a stationary mid-section 13 and a pivotal foot section 14. The head and foot sections 12 and 14 are each capable of being raised and lowered by the operation of a bed control 15, that may be manually operable or automatically controllable.

Figure 2:
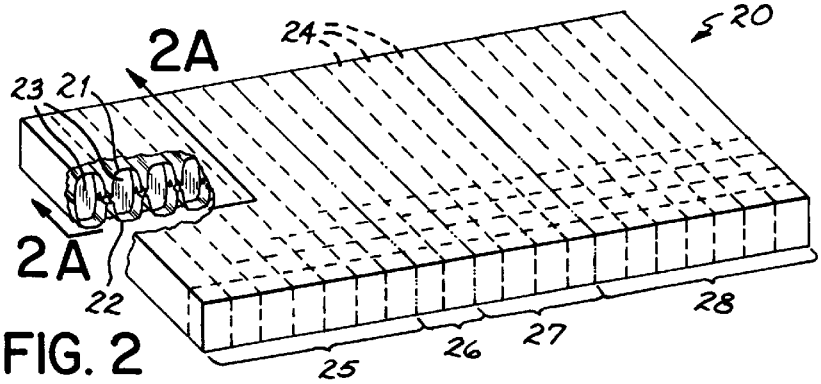
FIG. 2 is a diagram illustrating certain details of an air mattress in the system of FIG. 1.
Figure 2A:
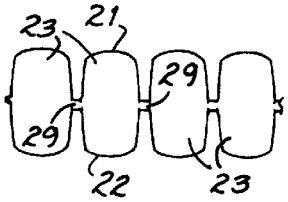
FIG. 2A is an enlarge view of a portion of the mattress of FIG. 2.

The system 10 also includes a multiple zone air mattress 20 that is supported upon the bed 11. The mattress 20, illustrated in more detail in FIG. 2, is formed of two air impermeable sheets 21 and 22 that are vacuum formed and laminated together to define a matrix of air chambers or cells 23. The cells 23 are, in the illustrated embodiment, arranged in a plurality of transverse rows 24, which are, for example, ten to twenty rows in number. The cells 23 of the rows 24 are grouped into four zones, including a head zone 25, a waist zone 26, a hip zone 27 and a leg zone 28, with the cells 23 within each of the zones 25–28 being pneumatically interconnected by bleeder ports 29 formed in the walls of adjacent cells of a zone where the laminations between the sheets are located. The ports 29 permit the equalization of pressure within the cells 23 of the respective zones 25–28, allowing for a redistribution of the air among such cells when the user who is reclining upon the bed moves. In the illustrated embodiment, the mattress 20 may be formed of fourteen to seventeen rows 24, including, for example, the head zone 25 is made up of the four to seven rows of cells 23 at one end of the mattress 20, the waist zone 26 is made up of the two rows of cells 20 adjacent the head zone 25, the hip zone 27 is made up of the four rows of cells 23 adjacent the waist zone the foot zone 28 is made up of the four rows of cells 23 adjacent the hip zone 27 and at the opposite end of the mattress 20 from the head zone 25. One such mattress 20 is described and illustrated in more detail in U.S. Pat. No. 4,662,012 of Torbet, while another is described and illustrated in U.S. Pat. No. 5,062,169 of Kennedy et al., both incorporated by reference herein.

The pressures within the zones of the mattress 20 are maintained and regulated by an airbed control 30 to separately control the pressures within the zones of the mattress 20. The control 30 includes a controller module 31, which contains pneumatic components including an air pump or compressor 32 that has an air inlet 33 communicating with atmosphere and an outlet 34 that connects through a respective one of four normally closed solenoid inflation valves 35*a*–38*a* to respective inlets of the air mattress zones 25–28. Preferably also, a muffler or accumulator tank 39 is connected to the outlet of the pump 32, between the pump 32 and the valves 35*a*–38*a* to smooth the air flow and minimize cycling of the pump 32. The pneumatic components also include a bank of four normally closed solenoid deflation valves 35*b*–38*b* that are connected in respective outlets from each of the respective zones 25–28 which vent to atmosphere. The use of only two valves 35–38 (*a* and *b*) for each of the zones 25–28 provides one preferred way to separately control the inflation and deflation of each of the zones 25–28. A number of other valve schemes can be used that employ multiple way valves or valve networks. Such alternative valve schemes can be used with the control logic described below, some with modifications thereto that would be routine to a control engineer based on the information provided herein.

The airbed control 30 also includes a user interface or hand wand 40 that connects through a cable, such as a modular cable, to a control interface connector 41 on the controller module 31, which in turn connects to a control circuit 42 within the module 31, and a power supply 43, which powers the circuit 42 and energizes the pump 32 through a solid state switch 44, which has a gate or control line activated by an output of the circuit 42. The module 31 is provided with four air line connector ports 45–48 through which are interconnected the four inflation valves 35*a*–38*a*, the four deflation valves 35*b*–38*b* and the four mattress zones 25–28. The control circuit 42 includes a microprocessor 50. The microprocessor 50 controls the valves 35*a*–38*a* and 35*b*–38*b* and the pump actuation switch 44 in response signals from the user interface control 40, from a deflate switch 51 on the module 31, from an auxiliary input 52 that connects either to the bed control 15 or sensor switches 53 and 54 on the head and foot sections of the bed 11, and from a set of four pressure sensors 55–58, which generate analog signals in response to measurements of the pressures on lines between the ports 45–48 and the valves 35*a*–38*a* and 35*b*–38*b*.

In the circuit 42 is provided a non-volatile memory 60, which is connected to the microprocessor 50. Additionally, provided are a crystal oscillator 61, and a reset chip 62, both connected to the microprocessor 50. Also, a pair of power output amplifiers or drivers 63*a*, 63*b* are provided from outputs of the microprocessor 50 through respective modular jacks 64*a*, 64*b* to the solenoids of the respective banks of valves 35*a*–38*a*, 35*b*–38*b*. Interface circuitry 65 may also be provided in the circuit 42 between the wand port 41 and inputs of the microprocessor 50. The deflate switch 51, which is preferably a momentary switch, may also connect to an input of the microprocessor 50 through the interface circuitry 65. The interface also preferably interconnects input and output terminals of the microprocessor 50 with a communications port 66, which connects to one or more items of communications equipment 67, such as a communications network 67*a*, a data recorder 67*b*, an alarm 67*c* or other indicator or display components or a computer system 67*d*. Such a communications function can be used to monitor or record the activities of a patient on a hospital bed 11, and can be also used to provide supervision and monitoring of patient care, such as a record of when attendants have turned a patient or when a patient has moved to a sitting position or has left the bed.

Figure 3:
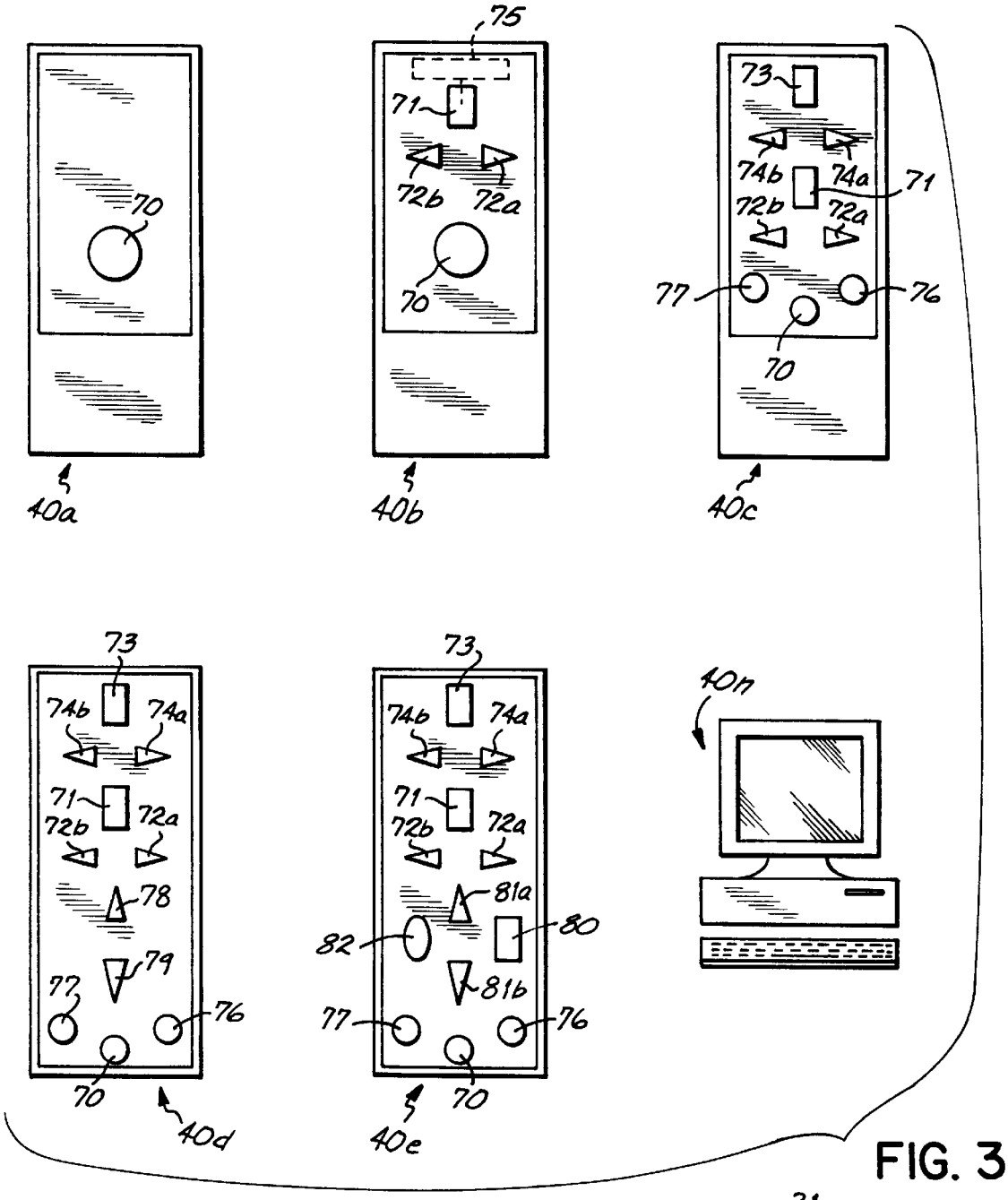
FIG. 3 is a diagram illustrating various user interface controls in various embodiments of the system of FIG. 1.

The user interface port 41, according to one embodiment of the invention, is configured to interface with a variety of interchangeable user interface devices 40, ranging from a simple ON/OFF control 40*a* having a single push-on/push-off button 70 to a computer control 40*n*, as illustrated in FIG. 3. The alternative interface control devices 40 having capabilities between those of the devices 40*a* and 40*n* include a second version 40*b* that includes the ON/OFF button 70 of the simple control 40*a*, and additionally has a firmness control feature that includes an LED 71, which displays a number to the user representing the overall firmness of the mattress 20, and a pair of UP or DOWN or±-buttons 72*a*, 72*b* by which the user can cause the overall pressure mattress 20 to increase or decrease.

Similarly, a more sophisticated control 40*c* may be connected to the connector 41 that includes, in addition to the control features of the control 40*b*, an individual zone pressure control feature, which provides capability for selectively raising or lowering the pressures of the respective zones 25–28. For this version of the control, an LED 73 is provided that displays either a number "1" through "4" indicating which of the zones HEAD, WAIST, HIP or LEG is selected, or a "0" indicating that all of the zones will be simultaneously adjusted. Alternatively, other indicator concepts, such as a series of lighted and labeled indicators, can be used to inform the user of the zone that is enabled for manual control by the user. The selection is made on a pair of buttons 74*a*, 74*b* provided to step, up or down, the selection number. When the selection is made, the pressure of the zone is displayed on the LED 71 while the pressure can be changed, up or down, through pressing of the buttons 72*a*, 72*b*. For one or more LEDs, an LED controller 75 is provided in the control device 40. The control device 40*c* may, in the alternative or in addition, further include a RESET button 76, that would undo all user adjustments to the firmness or zone pressures and restore the pressures of the zones 25–28 to preset factory settings. An additional CALIBRATE button 77 may be provided that will cause the microprocessor 50 to execute a program that will calculate the proper zone pressures, which may be customized to the particular user, as for example, the process described and referred to below as the LEARN mode.

A further and more sophisticated version of the control device 40 is a fourth version 40*d*, which includes, in addition to the features of device 40*c*, additional buttons 78 and 79, which provide user access to other features, such as a HYPERINFLATE function, initiated by the button 78, to pressurize the bed to raise a hospital patient, for example, to a level for examination. Button 79 may provide a HIP-DEFLATE function. In lieu of providing extra buttons such as buttons 78 and 79 for specific functions, in the fifth version 40*e* of the control device 40, menu selection of auxiliary functions is provided. In the device 40*e*, a LED 80 displays a function identification or code. The user can step through functions by pressing up and down stepping buttons 81*a* or 81*b*, indexing the display of LED 80. When the function is selected, the user may execute the function by pressing an EXECUTE button 82. The functions available by such a control device 40*e* would be programmable and could vary from user to user. For service personnel primarily, the computer interface 40*n* can be used to access maintenance functions, and, to change program options or code in the microprocessor 50. Such an interface 40*n* can, for example, change the programmed functions accessible by a user having the control device 40*e*, or the functions that would be actuated by buttons or control elements on others of the control devices 40.

PROGRAMMING AND OPERATION

The operation of the control 30 is determined by the program that is stored in the read only memory embedded in the microprocessor 50 and executed thereby. The microprocessor ROM also stores default or factory pressure setting values for each of the zones as well as individual user setting values for each of the zones 25–28 that are, or under the specific command of the user or attendant, written to the EEPROM 60 from time to time, such as by the running of the LEARN or CALIBRATE mode or function, described below. The system 10 may be designed to be turned on by a master ON/OFF switch 90 on the module 31, which is in series with the power line to the power supply 43. The ON/OFF switch 70 on the remote control device 40 may also be a mechanical contact switch that is alternatively connected in series with the inlet side of the power supply 43, or the switch 70 may be separate from the switch 90 that controls the power supply 43, allowing some level of power to remain on when the switch 70 is turned off, which could allow for retention of information in volatile memory, if desired, in the microprocessor 50 or as an external memory thereto, in addition to the non-volatile memory 60. In the preferred embodiment, only the power to the pump 43 and pneumatic valves 35–38 is turned off, leaving the sensors 55–58 and circuit 42 on, so that pressure information will be constantly communicated to the communications equipment 67 connected to the communications port 66.

When the control 30 is on, the control is programmed to turn off the pump 43 after an interval of, for example, 15 seconds of non-use, thereby conserving power. When the control circuit 42 of the control 30 is turned on, reset circuit 62 or other logic provided initializes the microprocessor 50,as illustrated in the flow in the flowchart of FIG. 4. In this condition, as in the off condition that results when the system 10 is turned off or is off as a result of a power failure, all of the valves 35*a*–38*a* and 35*b*–38*b* are closed, and the pump 43 is off, with whatever mass of air is in the zones 25–28 being maintained in a static condition. The first step of the program that is loaded from the EEPROM 60 is to check to determine if user defined pressure SETTINGS have been entered and retained in memory in the EEPROM 60 for each of the four zones 25–28 of the mattress 20. If such user defined SETTINGS have not been entered and retained, factory or installer set default data is used, which might be generic data for all users or data for a particular class of users, such as users in a particular weight range. The factory set pressures might be, for example, 6 inches of water for the head zone 25, 9 inches of water for the waist zone 26, 8 inches of water for the hip zone 27 and 4 inches of water for the leg zone 28. These numbers, or whatever numbers are used, should be those determined to be the most likely to properly support the body of a user, based on statistical analysis of measured zone pressure data for a sample of users, given an air mattress of a given number of zones, configuration and construction. The default values of 6,9,8,4 are preferred for the mattress 20 of the illustrated embodiment.

Figure 5:
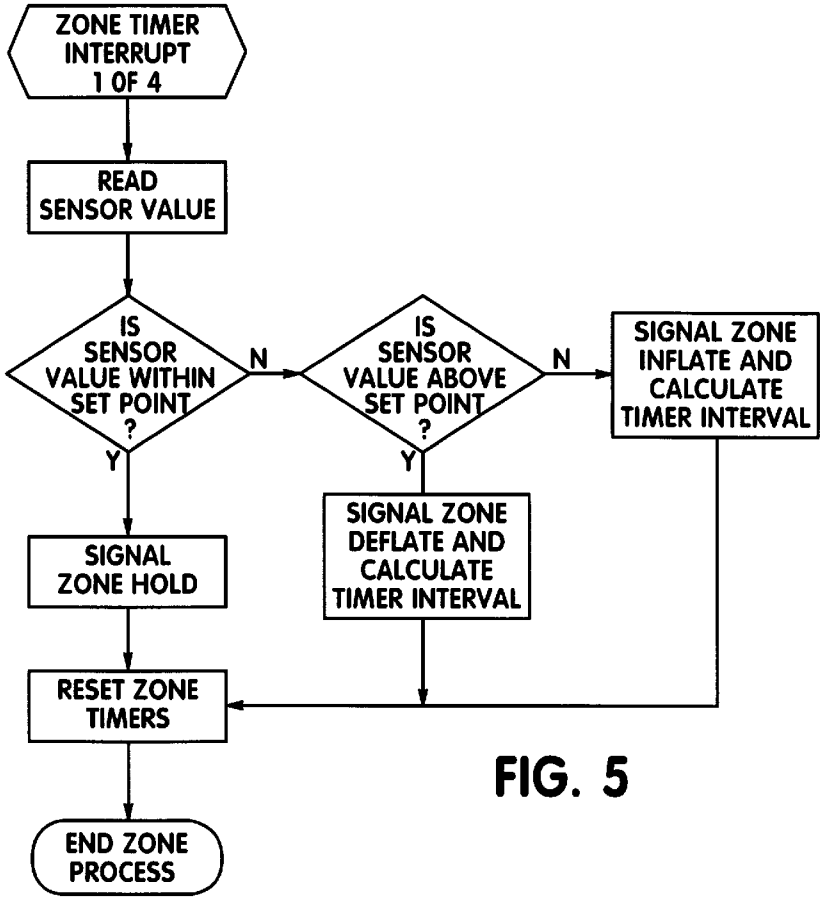
FIG. 5 is a flowchart of the interrupt routine of the program illustrated in the flowchart of FIG. 4.

When the initial pressure SETTINGS for the zones 25–28 are determined, timers are set to control the sampling intervals at which the microprocessor 50 is to run an interrupt routine, as illustrated in the flowchart of FIG. 5, to interpret pressure readings from the pressure sensors 55–58. Then, the processor 50 enters the main program loop, which performs two functions. The first function performed by the main loop is to run an interface processing routine, illustrated in the flowchart of FIG. 6 to interrogate the hand control 40 to determine if any buttons are pushed or any other commands provided thereon have been entered, and second to turn solenoids of the valves 35*a*–38*a* or 35*b*–38*b* (hereafter collectively designated valves 35–38) on or off, as indicated by interrupt flags, if any, that have been set by a timer interrupt routine, illustrated in the flowchart of FIG. 5. The interrupt routine is run periodically, upon checking the zone timer interrupt flag that is periodically set by the timing out of the zone interval timer.

When the user interface processing routine is run, the program may use any of a number of known schemes to determine the type of wand 40 that is connected to the user interface port 41. The program may test the status of the various pins or conductors at the port 41 to identify unique identifying electrical characteristics of the different control devices 40. In the alternative, as with the illustrated embodiment, the program is generically written and interprets the absence of a button press in the same way as the absence of a button or feature of the device 40. Alternatively, the program can store information received from the device 40 and use the information to configure the program to most efficiently work with the type of device 40 that is in use. In any event, the user interface routine will determine that the configuration of the device 40 is determined before polling the pins of the interface connector 41 for button press signals. Thus, it is preferred that the presence of the MENU buttons 81 be determined early in the polling process. In that way, the EXECUTE button 82 could be associated with the same logical function as a dedicated button of another type of device 40.

The order of polling of the buttons or other controls that may be provided is preferably, following the menu selection determination, if provided, to check for a zone selection change, signaled by the user with buttons 74*a*, 74*b*, by reading the flag therefor. The button flags are set upon the release of a button, with setting of the first flag disabling any further flag settings until the flags are reset, so that only one button press can be recognized at a time. Simultaneous button presses will be ignored by the program. When a zone change is signaled, a zone counter in volatile memory is indexed up or down and the current zone is displayed on the LED 73.

Figure 4:
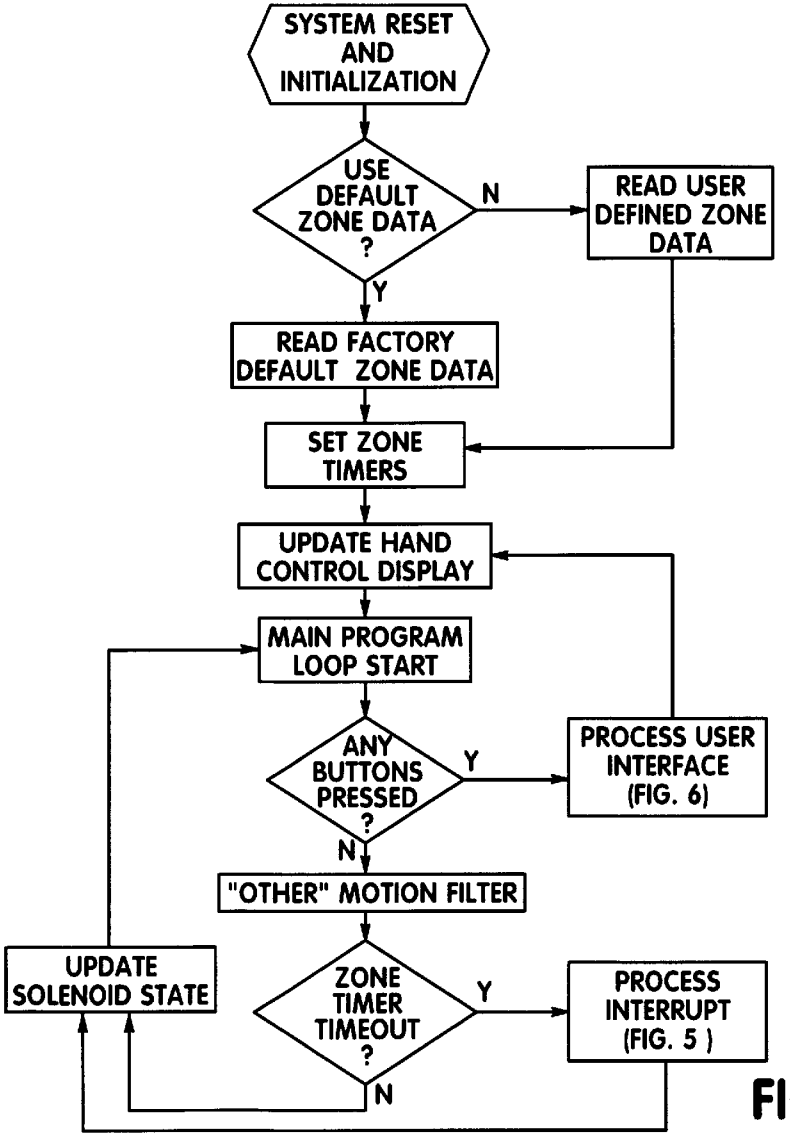
FIG. 4 is a flowchart of the main portion of the programming of the microprocessor of the control portion of the system of FIG. 1.

Next, buttons 72*a*, 72*b* are checked to determine if a pressure change is signaled by the user. If so, a pressure OFFSET value in volatile memory within the microprocessor 50 or in a separate memory chip is incremented or decremented. The actual pressure change will not, however, be implemented until the UPDATE SOLENOID STATES step is performed in the main program loop (FIG. 4). Next, the ON/OFF button 70 is checked and processed directly. Then other buttons are sequentially checked, such as the RESET button 76, the HYPERINFLATE button 78 and the DEFLATE button 79, and, if selected, the corresponding routine is executed. Other functions, such as a "save settings to EEPROM" function, as well as other functions can be optionally provided for here. Then the CALIBRATE or LEARN mode button 77 is checked and, if selected, the routine is executed to recalculate user SETTINGS.

When the simple on/off control 40*a* is used, the only button function to check is that for an ON/OFF command. With such a control 40*a*, during startup, the program repeatedly executes the main loop until flags are set by the interrupt routine indicating that the initial pressures, for example of the default values of 6,9,8,4 inches of water, are not present in the respective zones 25–28. Thus, when the zone timer interrupt is triggered, a timeout interrupt flag is set. This flag is read in the execution of the main loop and, if set, the INTERRUPT routine of FIG. 5 is executed, in which each of the sensors 55–58 is sequentially read at analog to digital ports of the microprocessor 50. In the interrupt routine, a first sensor 55 is read. If the reading is within a predetermined range of the set point value, for example within ±¼ inches of water of, for example, the default value of for example 6 inches of water, no flags are set. If no flags are set, the main loop, in its next cycle, will not cause any solenoid states of the valves 35*a* or 35*b* (hereafter collectively referred to as the valves 35) to change.

If the value is above the set value of 6 inches of water, a flag is set and a calculation is made to determine a time slightly less than that estimated to allow the pressure in zone 25 to be reduced to the set point pressure by an opening of the deflation valve 35*b* for the zone 25. If the pressure were too low in zone 25, a flag would have been set and a calculation made of to determine the time that valve 35*a* must be opened and the pump 43 run to increase the pressure in zone 25 to that of the set point value. One reset timer is provided for each of the two functions, inflate or deflate, for each zone. The purpose of the reset timers and the calculations of the reset intervals is to minimize the amount of state changing of the valves 35–38 and the amount of cycling of the pump 43. The inflate and deflate times of each of the zones will differ due to the differing sizes of the zones 25–28 and the different pressures to which they may be inflated. With the reset timers, the valves remain open for periods set by the timers, and the program continues to execute simultaneously while the valves are open. Accordingly, before one valve has closed, another zone can be selected for correction or adjustment, and the opening of one of its valves can overlap with the opening of the valve previously opened. When one valve is opened for a zone, however, further valve actuation for that zone is locked out until the reset timer for that zone has timed out. The readings of the remaining sensors 56–68 are similarly processed and flags and timers are similarly set for the valves 36–38. Upon exit from the INTERRUPT routine, the zone timer is reset.

Then, as the program continues to cycle through the main loop, the UPDATE SOLENOID STATES step is executed, in which, if the pressure in any of the zones 25–28 is too high, the corresponding one or ones of the valves 35*b*–38*b* is opened for a period of time determined by the setting of the reset timer corresponding to the valve. If the pressure in any of the zones 25–28 is too low, the corresponding valve 35*a*–38*a* will be opened for a period of time determined by the setting of the reset timer corresponding to the valve. Where an accumulator 39 is not present, the opening of the pressure increase valves 35*a*–38*a* would usually require a corresponding interval of operation of the pump 32. With an accumulator tank used as the muffler 39, the operation of the pump 32 may be controlled by a pressure sensor 91 on the outlet line 34 of the pump 32 in order to maintain a nearly constant pressure, or a pressure within a given range, on the line 34. The use of an accumulator 39 would, however, produce a substantially larger unit, which is not preferred.

During use, whenever a pressure is sensed through the sensors 55–58 that is not within the set point for a given zone, the zone pressure of that zone is adjusted, as set forth above for the initial pressure setting. If the pressure is initially adjusted when there is no user reclining on the mattress 20, then the addition of the user onto the mattress 20 will result in a measured pressure change, that will be sensed by the sensors 55–58, which will cause the adjustment step, referred to above as the UPDATE SOLENOID STATES step in the flowchart of FIG. 1, to be executed to change the status of the appropriate valve or valves 35–38. Similarly, when a user moves while reclining on a bed, the sensed pressure change, if any, that results will initiate such an adjustment step. Also, loss of pressure for any reason, perhaps due to slow leakage, when it causes the pressure in any zone to drop below the corresponding set pressure for the zone, to increase the pressure in that zone. However, stable adjustment is maintained, and the oscillating of corrections by repeatedly inflating and deflating one or more zones are avoided, by ignoring transient measurements by the sensors 55–58, such as might be caused by an abrupt movement of a user. This is accomplished by validating all sensor measurements by setting flags on the first out-of-range reading and verifying by taking a second measurement after a delay of a short period of time, such as an interval of one second, five seconds, or some other short interval.

Where the sensor 40*b* is used, the interface processing routine of the flowchart of FIG. 5 will detect any presses of buttons 72*a* or 72*b*. This checking is preferably programmed to occur without any setting of the program designating the wand or hand control 40 being used. If a control 40*a* is replaced by a control 40*b*, the program will automatically respond to a pressing of buttons 72*a*, 72*b*, as the absence of such buttons with control 40*a* will be interpreted the same as if as no button press has been made with a control 40*b*. Similarly, when the control connected to the interface port 41 is the control 40*b*, a number will be sent to the LED controller 75 to update the display on the LED 71, representing the general firmness of the mattress 20. When a user operates one of the buttons 72*a* or 72*b* signalling that the firmness of the mattress 20 is to be increased or decreased, the OFFSET values for all of the zones 25–28 in volatile memory will be incremented or decremented. As a result, the valves 35*a*–38*a* or the valves 35*b*–38*b* will be respectively activated, in the course of the execution of the UPDATE SOLENOID STATES step of the program main loop as explained above, to affect the new firmness adjustment selected by the user. With a firmness setting, all of the zones 25–28 can be increased or decreased by equal amounts of pressure, or may be proportionately increased or decreased in pressure, or may be increased or decreased in pressure by some algorithm that has been statistically determined to be appropriate for proper body support, such as for a preferred spinal alignment, for comfort, or to achieve some other criteria. When such a firmness adjustment is made, the new values become the new setpoints at which the pressures in the zones 25–28 will be maintained.

Where the wand or interface control device 40*c* is used, the user is given the additional ability to individually and separately vary the pressures in each of the zones 25–28 by selectively choosing one of the zones 25–28, or all of the zones, to be manually adjusted. This is achieved by pressing one of the buttons 74*a*, 74*b*. When the wand 40*c* is connected to the wand or user interface port 41, the microprocessor sends a signal to the LED driver 75 to display a number indicating the zone selection that is in effect, which number is stored in memory. Thereafter, when the PROCESS USER INTERFACE routine next polls the buttons, the next user commands caused by the pressing of buttons 74*a* or 74*b* will increment or decrement only the OFFSET value for the particular zone selected. When such a manual adjustment of a selected zone or zones is so signaled by the user, in the execution of the UPDATE SOLENOID STATES step of the main loop as explained above, appropriate settings of the respective one or ones of the valves 35–38 are made to implement the selected manual adjustments. Such adjustments become the new setpoints at which the pressures in the zones 25–28 will be maintained by the automated control.

When the control device or wand 40*d* is connected to the interface port 41, the microprocessor interrogates the buttons 78 and 79 to respectively determine if hyperinflation has been selected, in which case the firmness of the mattress 20 is increased in all zones 25–28, making it easier for a user who is a patient in a hospital, for example, to be treated, or if hip deflation is selected, in which case the zone 27 is reduced to a nominal pressure, making it easier for the user to sit up. With the control device 40*e*, the button 82 can be made to represent selection of the functions of either of the buttons 78 or 79, or any other function programmed for the microprocessor 50. Such a menu feature is particularly useful to provide access to less frequently used functions, such as a CALIBRATE or LEARN function (explained below), or a SAVE function that will save to the EEPROM 60 the adjusted zone pressures, which are the sums of the current user setting values plus the offset values, or a RESET function that will reset to zero the adjustment or OFFSET values in volatile memory. The selection of such function is achieved by stepping through a menu, displayed by a signal from the microprocessor 50 on LED 80, by depressing the up and down buttons 81*a* or 81*b*.

Control devices 40*c*–40*e*, as illustrated in FIG. 4 may also include RESET command button 76, by which all user adjustments can be cancelled and the settings returned to the initial settings. The RESET button 76 may or may not be included with a separate CALIBRATE button 77, which can be used to determine individual user settings, which may involve the execution of a program routine that performs an algorithm to calculate settings ideal or preferred for a particular user, as set forth in the discussion of a LEARN mode below. When the RESET button 76 is provided in combination with a CALIBRATE button 77, or when both functions are provided on the menu of a control device of the type 40*e*, the RESET button 76, or its menu function, may be set to return the settings either to the customized user settings achieved by the CALIBRATE function, or to the initial settings used at power-on or startup, or following system reset and initialization.

As stated above, the CALIBRATE button 77 or the CALIBRATE function, however selected, may be used to calculate user settings for each of the zones 25–28 that are ideal for a particular user, and particularly, that will result in maintained adjustment of the mattress 20 so that the body of the user is properly supported at the lowest possible pressure, without the mattress bottoming out. This is referred to herein as the LEARN mode, and results in a routine in a recalculation of user zone settings. The routine is initiated following interrogation of the status of the CALIBRATE or "LEARN" button 77 in the user interface processing routine to detect that the flag has been set as a result of the button 77 being pressed. When the CALIBRATE or LEARN button 77 is pressed, the user should not be reclining on the mattress 20. This allows the four zones 25–28 of the mattress 20 to be inflated to initial default pressures, 6, 9, 8 and 4 inches of water, respectively, under the control of the main loop of the program, as described above. When the predetermined initial pressures have been achieved, the microprocessor 50 causes all eight of the valves 35–38 to close and an indication to appear on one of the LEDS on whatever control 40*c*–40*e* is in use that signals the user to recline upon the mattress 20. When the user has arrived at the preferred reclining position on the mattress 20, the user again presses the CALIBRATE or LEARN button 77, which signals the microprocessor to proceed with the execution of the calculation of the ideal pressure settings for the user. Pressing the RESET button 76 instead of pressing the LEARN button 77 for the second time may, at this stage, or pressing the RESET and LEARN buttons simultaneously, may be programmed to cause a resetting in the EEPROM 60 of the settings back to the factory default values. This alternative would provide for the RESET button 76 to be used alone only to reset to zero the OFFSETS or adjustments made by the user since the last setting of the user values.

Execution of the SETTINGS calculation step in the LEARN mode begins with the step of reading the pressures sensed by each of the four sensors 55–58, with the valves 35–38 maintained in a closed condition, sealing the air that inflated the mattress to its original pressures within each of the zones 25–28. The pressures will have changed from the initial pressures of 6,9,8,4 initially set, due to the weight of the user upon the mattress 20. These measured pressures are referred to as the SEAL pressures of each of the four zones, and may be designated SEAL_HD for the head seal pressure measured with sensor 55 at zone 25, SEAL_W for the waist seal pressure measured with sensor 56 at zone 26, SEAL_HP for the hip seal pressure measured with sensor 57 at zone 57 and SEAL_F for the foot or leg seal pressure measured with sensor 58 at zone 38.

From the seal pressures, an adjustment number is calculated. The adjustment number, referred to herein as ADJ_NUM, is calculated as a function of the seal pressures. From the adjustment number ADJ_NUM are calculated four ideal support pressures, or ALIGN pressures. These ALIGN pressures are the pressures that are predicted to cause the person (who reclined upon the mattress and resulted in the generation of the four measured SEAL pressures) to be properly supported on the mattress 20 at the lowest possible pressure. These four ALIGN pressures, referred to herein as the variables ALIGN_HD for the ideal ALIGN pressure for the head zone 25, ALIGN_W for the ideal ALIGN pressure for the waist zone 26, ALIGN_HP for the ideal ALIGN pressure for the hip zone 27 and ALIGN_F for the ideal ALIGN pressure for the head zone 28.

The functions or algorithms used to calculate ADJ_NUM and the four ALIGN pressures are derived by statistical analysis of data taken by a number of tests in which a number of users are asked to carry out the LEARN process, with the ALIGN pressures being manually set to such values that will cause the body of the user to be properly supported. The pressures are set so that the proper support occurs for the lowest zone pressures required for alignment without the sheets 21,22 from touching, that is, without the mattress 20 bottoming out. This is deemed the most comfortable and orthopedically desirable setting of the mattress 20, and the one least likely to cause bed sores, or to cause joint pain or other joint problems, or that would result in other undesirable conditions for hospital patients and other users.

A statistical analysis is preferably carried out by taking at least three sets of data of SEAL pressure measurements from each user and performing a "principal component analysis" using the average for each user. The first component from such an analysis, it is found, explains ninety percent of the measured seal pressure information. From this analysis, the adjustment number ADJ_NUM is defined as the following function of the SEAL pressures:

$$\text{ADJ_NUM}=0.505(\text{SEAL_HD})+0.510(\text{SEAL_W})+0.491(\text{SEAL_HP})+0.494(\text{SEAL_F}) \quad (1)$$

It is found that this adjustment number ADJ_NUM, so calculated, is highly correlated with the weight of the user. Then, using least squares linear regressions for the waist and hip zones 26 27, and a spline fit for the head and foot zones 25 and 28, the ALIGN pressures can be predicted as the following functions of ADJ_NUM:

$$\text{ALIGN_HD}=6.0 \text{ for ADJ_NUM}<=18.5 \;\&=8.0 \text{ for ADJ_NUM}>18.5 \quad (2)$$

$$\text{ALIGN_W}=-0.69+0.568(\text{ADJ_NUM})$$

$$\text{ALIGN_HP}=-1.69+0.568(\text{ADJ_NUM})$$

$$\text{ALIGN_F}=4.0 \text{ for ADJ_NUM}<=18.5 \;\&=5.5 \text{ for ADJ_NUM}=18.5$$

Figure 6:
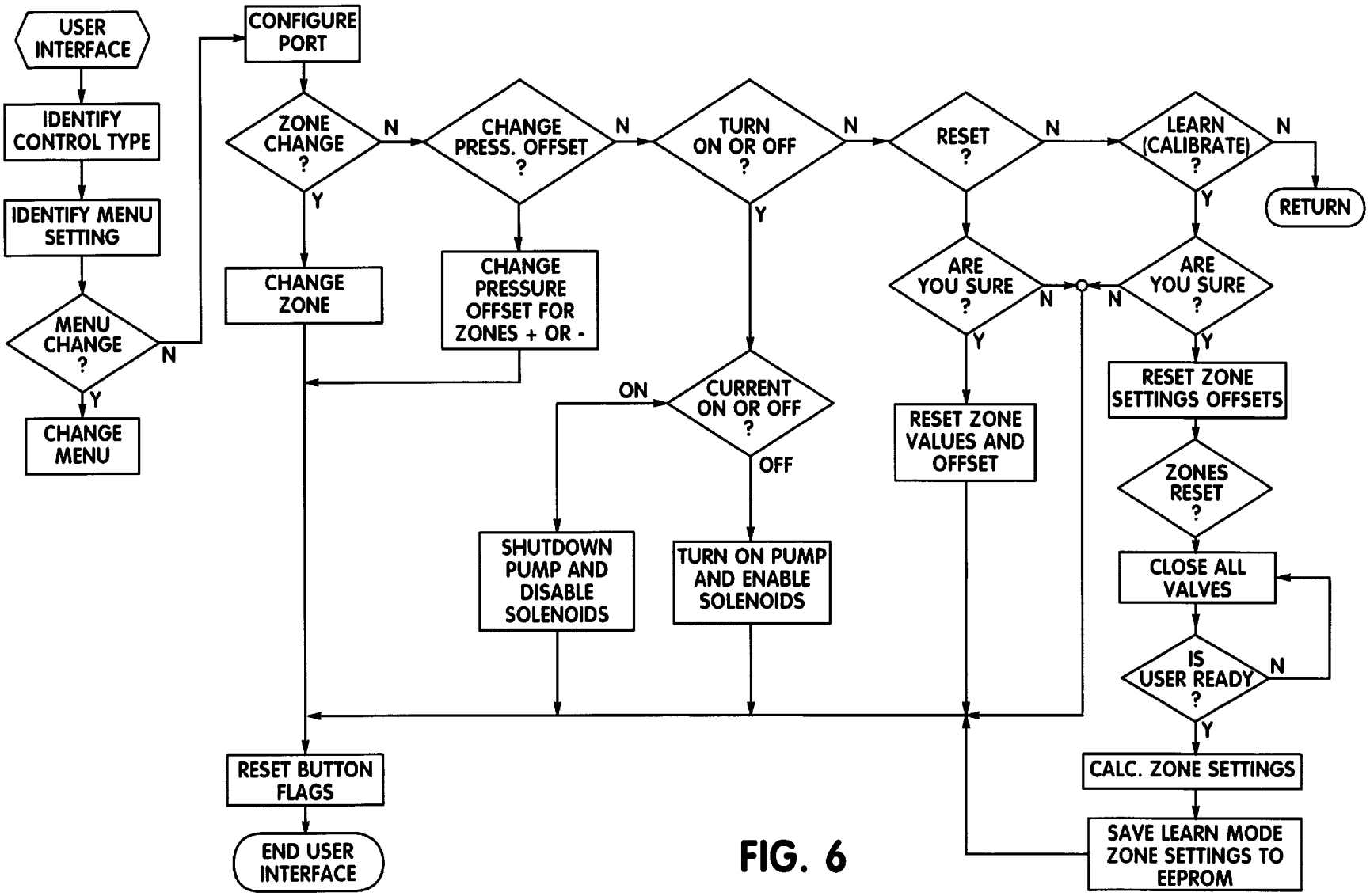
FIG. 6 is a flowchart of the user interface processing routine of the program illustrated in the flowchart of FIG. 4.

The above equations are used by the LEARN MODE routine of the routine of FIG. 6.

Thus, as an example, when a user has selected the LEARN mode by pressing the CALIBRATE button 77, the INTERFACE routine of FIG. 6, upon identifying the button 77 as having been pressed, the zones 25–28 are inflated to the pressures 6,9,8,4 inches of water, respectively, and sealed. The user then lies upon the mattress 20 and presses the CALIBRATE button 77 again. The user, having, for example, have a weight of 176 pounds and a height of 71 inches, might produce SEAL pressures that are measured by the sensors 55–58 as:

SEAL_HD=9.08 inches of water

SEAL_W=11.50 inches of water

SEAL_HP=11.00 inches of water

SEAL_F=4.75 inches of water

From these measurements, ADJ_NUM is calculated from equation (1) to be 18.2. From this ADJ_NUM, the ALIGN pressures are calculated from equations (2) to be:

ALIGN_HD=6.0

ALIGN_W=9.6

ALIGN_HP=8.6

ALIGN_F=4.0

Then, having calculated the ALIGN pressures, these pressures are stored as the set point pressures for the particular user. Then, when the main loop executes the UPDATE SOLENOID STATES step, the pressures will be lowered from the SEAL pressures, which exist during the LEARN mode calculation, by opening of the valves 35*b*–38*b*. These pressures are then maintained at these calculated ALIGN pressures unless and until the user manually readjusts the pressures, in the manner explained above.

In addition to the functions discussed above, there is provided logic in the program to detect conditions that locally change the pressures in only some of the zones in a manner that is uncharacteristic of a user changing from one reclining position to another. For example, where a user sits on the edge of the bed 11, or sits up in bed, the user's weight will be concentrated in one or two zones, such as at the waist zone 26 and the hip zone 27. This motion of the user has the effect of substantially increasing the pressure at sensors 56 and 57, at least to the point that the mattress bottoms out at the edge at which the user is sitting. Such a pressure change characteristics are identified by comparing the measured pressures at the sensors 55–58 and comparing the measurements with a table of values that provide a basis for distinguishing between pressure measurements expected from the normal reclining motions of a user and pressure measurements produced by unexpected motions, particularly non-reclining motions caused by common known events, such as the sitting of the user at the edge of the bed. Such tests are performed by the OTHER MOTION FILTER step in the program main loop (FIG. 5), before the UPDATE SOLENOID STATES step is performed. Other such non-reclining motions can be detected by detection of unique static or dynamic pressure readings that are correlated therewith.

In addition, other activities of the user can be met with special pressure control that produces pressure settings that differ from the ideal support pressures for the user who is reclining. For example, when the mattress 20 is used on hospital beds, such as the bed 11 illustrated in FIG. 1, having adjustable head and foot sections 12 and 14, the raising of the head and foot of the bed will cause a concentration of the weight of the user at the hip zone 27, and also somewhat at the waist zone 26. Without special control of the pressures under such conditions, the mattress would bottom out in the hip zone 27 when the head and foot portions 12 and 14 of the bed 11 are raised. To provide such control, in one embodiment of the invention, the sensor switches 53,54 are level detector switches, such as mercury switches, that generate a signal indicating that the head section 12 or foot section 14 of the bed have been raised to an angle greater than, for example, twenty degrees or some other angle determined to be the angle at which the weight of the user tends to concentrate substantially on the hip or waist zones 27 or 26, respectively, of the mattress. When such a signal is detected indication that the head or foot of the bed has been raised, the hip zone 27, and perhaps also the waist zone 26, are sealed by closing of the valves pairs 36 and 37, disabling the adjustment function as to these zones. Alternatively, rather than merely seal the zone 27, the hip zone 27 as well as one or more of the adjacent zones may be inflated or deflated to special predetermined or calculated pressures other than the support or ALIGN pressures described above. Also, rather than relying on limit switches, information can be derived directly form the control of the bed, or from any other sensor or other external source of information. Additionally, the information of bed angle adjustment, or "gatching" as it is referred to in connection with the hospital beds and other hospital equipment, may be detected by an analysis of the pressure sensing information from the sensors 55–58, as read by the communications equipment 67 connected to the communications port 66.

Those skilled in the art will appreciate that additions and modifications of the described embodiments of the method of the present invention can be made without departing from the principles of the invention.

Accordingly, the following is claimed:

1. An airbed comprising:

a frame;

a mattress supported on the frame and having a plurality of separately pressurizable zones;

an inflation pressure control including:

an air pump having an outlet, valve means for forming a normally closed inlet passage between the pump and each of the zones of the mattress for selectively controlling air flow to each of the zones, and for forming a normally closed outlet passage between each of the zones of the mattress and atmospheric pressure for selectively controlling air flow from each of the zones of the mattress, the valve means having at least one control input and being responsive to a control signal on the control input to selectively open at least one of the valve passages, a programmable processor having outputs connected in communication with the at least one control input, a non-volatile memory connected to the processor, a plurality of pressure sensors, one connected to each of the zones, and each having an output connected to the processor, and the processor including means for detecting non-reclining movements of a user present on the mattress by comparing the pressures detected by the sensors with data of normal reclining motions stored in memory and generating control signals to the at least one control input to cause the valves to operate to maintain the pressures within the zones at preset reclining pressures in response to reclining movements of a user reclining on the mattress, and to control the pressures in the zones at non-reclining pressures in response to detected nonstandard movements of the user.

2. The airbed of claim 1 wherein:

the non-reclining movement is a person sitting on fewer than all of the zones of the mattress, and the processor is programmed to interpret the pressures measured by the sensors to distinguish movements made by the user reclining on the mattress from non-reclining movements of the user.

3. The airbed of claim 1 wherein:

the bed includes tiltable sections and means for signaling the tilting of the sections to at least a predetermined inclination angle;

the processor includes program means responsive to the signaling means for distinguishing movements made by the user reclining on the mattress from non-reclining movements of the user and for generating the outputs in accordance therewith.

4. An airbed comprising:

a frame;

a mattress supported on the frame and having a plurality of separately pressurizable zones;

an inflation pressure control including:

an air pump having an outlet, valve means for forming a normally closed inlet passage between the pump and each of the zones of the mattress for selectively controlling air flow to each of the zones, and for forming a normally closed outlet passage between each of the zones of the mattress and atmospheric pressure for selectively controlling air flow from each of the zones of the mattress, the valve means having at least one control input and being responsive to a control signal on the control input to selectively open at least one of the valve passages, a programmable processor having outputs connected in communication with the at least one control input, a non-volatile memory connected to the processor, a plurality of pressure sensors, one connected to each of the zones, and each having an output connected to the processor, the processor being programmed to detect non-reclining movements of a user present on the mattress, and to generate control signals to the at least one control input to cause the valves to operate to maintain the pressures within the zones at preset reclining pressures in response to reclining movements of a user reclining on the mattress, and to control the pressures in the zones at non-reclining pressures in response to detected nonstandard movements of the user;

at least one tiltable bed section;

means for signaling the tilting of the sections to at least a predetermined inclination angle; and the signaling means including level detectors connected to the sections.

5. An airbed comprising:

a frame;

a mattress supported on the frame and having a plurality of separately pressurizable zones;

an inflation pressure control including:

an air pump having an outlet, valve means for forming a normally closed inlet passage between the pump and each of the zones of the mattress for selectively controlling air flow to each of the zones, and for forming a normally closed outlet passage between each of the zones of the mattress and atmospheric pressure for selectively controlling air flow from each of the zones of the mattress, the valve means having at least one control input and being responsive to a control signal on the control input to selectively open at least one of the valve passages, a programmable processor having outputs connected in communication with the at least one control input, a non-volatile memory connected to the processor, a plurality of pressure sensors, one connected to each of the zones, and each having an output connected to the processor, the processor being programmed to detect non-reclining movements of a user present on the mattress, and to generate control signals to the at least one control input to cause the valves to operate to maintain the pressures within the zones at preset reclining pressures in response to reclining movements of a user reclining on the mattress, and to control the pressures in the zones at non-reclining pressures in response to detected nonstandard movements of the user;

at least one tiltable bed section;

means for signaling the tilting of the sections to at least a predetermined inclination angle; and the signaling means including means for measuring the pressures in the zones of the mattress and means for analyzing the measured pressures to detect therefrom the change of inclination angles of the sections.

6. An air bed control for controlling the levels of pressure within the zones of a multiple zone air mattress, comprising:

an air compressor having an outlet, a plurality of pneumatic inlet passages, each having a normally closed inlet valve element therein and connected one between the pump and each of the zones of the mattress, a plurality of pneumatic outlet passages, each having a normally closed outlet valve element therein and connected one between each of the zones of the mattress and atmospheric pressure, each of the valve elements having a control input associated therewith and being responsive to a control signal on the control input to open the valve, a programmable processor having outputs connected in communication with a control input associated with each of the valve elements, a non-volatile memory connected to the processor, a plurality of pressure sensors, one connected to each of the zones, and each having an output connected to the processor, a control input device of one configuration of a plurality of available configurations connected to the processor, the processor including program means for determining the configuration of the control input device connected thereto and for altering the control of the valve elements to regulate the pressures in each of the zones of the mattress in accordance with the configuration of the control input device.

7. The control of claim 6 wherein:

the plurality of available configurations includes configurations having a different number of command buttons having different command functions; and the processor is programmed to control the valves differently in accordance with the functions of the configuration of the connected device.

8. A method of controlling the pressures of air within the zones of a multiple zone air mattress at pressure settings custom for an individual user, the method comprising the steps of:

with no user reclining on the mattress, establishing the pressures in each of the zones at respective predetermined initial pressure levels; then sealing air at the established pressures within each of the zones; then with the user reclining on the mattress, measuring the pressures in each of the zones and communicating pressure measurements thereof to a processor; then calculating with the processor, from the pressure measurements, pressure settings for each of the zones that are ideal for the user; then storing the calculated pressure settings in a memory; then automatically regulating the pressure of air in each of the zones at levels corresponding to the stored calculated pressure settings; and wherein the calculating step includes the steps of:

reducing the pressure measurements to a number in accordance with a preprogrammed function of the measurements; and calculating the pressure settings that are ideal for each of the zones as a preprogrammed function of the number.

9. The method of claim 8 wherein the zones include a head zone, a waist zone, a hip zone and a foot zone, and the calculating step includes the steps of:

reducing the pressure measurements to an adjustment number N approximately in accordance with the relationship:

$$N=w(HD)+x(W)+y(HP)+z(F),$$

where w, x, y, and z are constants and where HD, W, HP and F are the respective measurements of the pressures of the head, waist, hip and foot zones;

calculating the pressure settings that are ideal for each of the zones approximately according to the relationship by which:

the ideal pressures of the head zone and the foot zone are each set at one of a limited set of constants that is higher where N is higher, the ideal pressure of the waist zone equals: a+b(N), the ideal pressure of the hip zone equals: c+d(N), where a, b, c and d are constants.

10. The method of claim 8 wherein the zones include a head zone, a waist zone, a hip zone and a foot zone, and the calculating step includes the steps of:

reducing the pressure measurements to an adjustment number N approximately in accordance with the relationship:

$$N=0.505(HD)+0.51(W)+0.49(HP)+0.495(F)$$

where HD, W, HP and F are the respective measurements of the pressures of the head, waist, hip and foot zones;

calculating the pressure settings that are ideal for each of the zones approximately according to the relationship by which:

the ideal pressure of the head zone equals 6 where N is less than 18.5 and equals 8 where N is greater than 18.5, and the ideal pressure of the foot zone is 4 where N is less than 18.5 and is 5.5 where N is greater than 18.5, the ideal pressure of the waist zone equals:−0.7+0.57(N), the ideal pressure of the hip zone equals:−1.7+0.57(N), where all pressures are in inches of water.

11. An airbed control having a processor and a non-volatile memory configured for programming the processor to control the bed according the method comprising the steps of controlling the pressures of air within the zones of a multiple zone air mattress at pressure settings custom for an individual user, the method comprising the steps of:

with no user reclining on the mattress, establishing the pressures in each of the zones at respective predetermined initial pressure levels; then sealing air at the established pressures within each of the zones; then with the user reclining on the mattress, measuring the pressures in each of the zones and communicating pressure measurements thereof to a processor; then calculating with the processor, from the pressure measurements, pressure settings for each of the zones that are ideal for the user; then storing the calculated pressure settings in a memory; then automatically regulating the pressure of air in each of the zones at levels corresponding to the stored calculated pressure settings.

12. An airbed comprising:

a frame;

a mattress supported on the frame and having a plurality of separately pressurizable zones;

an inflation pressure control including:

an air pressure source having a constant pressure outlet, valve means for forming a normally closed inlet passage between the pump and each of the zones of the mattress for selectively controlling air flow to each of the zones, and for forming a normally closed outlet passage between each of the zones of the mattress and atmospheric pressure for selectively controlling air flow from each of the zones of the mattress, the valve means having at least one control input and being responsive to a control signal on the control input to selectively open at least one of the valve passages, a programmable processor having outputs connected in communication with the at least one control input, a plurality of pressure sensors, one connected to each of the zones, and each having an output connected to the processor, and the processor including program means for configuring the processor to respond to signals from the sensors indicating pressure variations occurring when the inlet passages to a zone are closed, for calculating and storing at least one ideal time interval for opening the passages to and from a zone, and for generating signals on an output of the processor to control air flow into and out of a zone of the mattress.

13. The airbed of claim 12 wherein:

the air source includes an air accumulator and a pump selectively operable to maintain air at the constant pressure at the outlet of the source.

14. The airbed of claim 12 wherein:

the program means includes means for establishing a separate time interval for each of the zones.

* * * * *